US008302701B2

(12) United States Patent
Morimura et al.

(10) Patent No.: US 8,302,701 B2
(45) Date of Patent: Nov. 6, 2012

(54) ELECTRIC POWER TOOL AND MOTOR CONTROL METHOD THEREOF

(75) Inventors: Kouichirou Morimura, Tokyo (JP); Kigen Agehara, Tokyo (JP)

(73) Assignee: Max Co., Ltd., Tokyo (JP)

( * ) Notice: Subject to any disclaimer, the term of this patent is extended or adjusted under 35 U.S.C. 154(b) by 311 days.

(21) Appl. No.: 12/720,913

(22) Filed: Mar. 10, 2010

(65) Prior Publication Data

US 2010/0252287 A1 Oct. 7, 2010

(30) Foreign Application Priority Data

Apr. 7, 2009 (JP) ..... P. 2009-092692

(51) Int. Cl.
*B25D 11/00* (2006.01)

(52) U.S. Cl. ..... 173/1; 173/9

(58) Field of Classification Search ..... 173/1, 9, 173/5

See application file for complete search history.

(56) References Cited

U.S. PATENT DOCUMENTS 4,249,117 A * 2/1981 Leukhardt et al. ..... 318/275
5,014,793 A * 5/1991 Germanton et al. ..... 173/181
5,154,242 A * 10/1992 Soshin et al. ..... 173/178
5,563,482 A * 10/1996 Shaw et al. ..... 318/272
5,914,882 A * 6/1999 Yeghiazarians ..... 700/177
6,479,958 B1 * 11/2002 Thompson et al. ..... 318/430
6,836,614 B2 * 12/2004 Gilmore ..... 388/811
2002/0050364 A1 * 5/2002 Suzuki et al. ..... 173/1
2003/0196824 A1 * 10/2003 Gass et al. ..... 173/131
2005/0205274 A1 * 9/2005 Bogue ..... 173/2
2006/0081386 A1 * 4/2006 Zhang et al. ..... 173/2
2009/0133894 A1 5/2009 Mizuhara
2010/0147545 A1 * 6/2010 Hirt et al. ..... 173/182

FOREIGN PATENT DOCUMENTS

JP 4-111779 4/1992
JP 2006-102826 4/2006

* cited by examiner

*Primary Examiner* — Brian D Nash
(74) *Attorney, Agent, or Firm* — Drinker Biddle & Reath LLP

(57) ABSTRACT

An electric power tool is provided with: a motor; a hydraulic pressure generator driven by the motor and configured to generate a plurality of impacts in one revolution thereof; an impact angle detector configured to detect an impact angle in one impact of the hydraulic pressure generator; an electric current detector configured to detect an electric current applied to the motor; a determination unit configured to determine an impact failure based on the impact angle and the electric current detected by the impact angle detector and the electric current detector; and a rotation controller configured to decrease a rotation speed of the motor when the determination unit determines the impact failure.

2 Claims, 9 Drawing Sheets

ELECTRIC POWER TOOL AND MOTOR CONTROL METHOD THEREOF

BACKGROUND OF THE INVENTION

1. Field of the Invention

This invention relates to an electric power tool in which a hydraulic pressure generator generates a plurality of impacts in one revolution thereof and a motor control method of the electric power tool.

2. Background Art

An electric power impact fastening tool as an electric power tool generally has a mechanism for generating one impact force per one revolution of a hydraulic pressure generator. (Refer to Patent Document 1.) In the electric power tool, a brushless DC motor is directly connected to an oil pulse unit to prevent occurrence of large vibration and reaction. (Refer to Patent Document 2.)

On the other hand, as an impulse wrench which is a hydraulic pressure power tool, there is a tool in which two impact forces per one revolution of a hydraulic pressure generator driven by compressed air (which will be hereinafter also called "two impacts per one revolution"). (Refer to Patent Document 3.) The tool of "two impacts per one revolution" generates a small torque and multiple impacts, thus a screwdriver, etc, is prevented from being away from a screw, etc. (which will be hereinafter called "come out"), at its operation time and an operation efficiency becomes good.

That is, a tool of "two impacts per one revolution" can perform a smooth fastening operation and a usability is good.

Patent Document 1: US2009/0133894

Patent Document 2: JP-A-2006-102826

Patent Document 3: JP-A-4-111779

A tool adopting the "two impacts per one revolution" as in Patent Document 3 is used for operations in which a rotation speed is small assuming a light load as compared with a tool of "one impact per one revolution". The reason is that: if the tool of "two impacts per one revolution" and the tool of "one impact per one revolution" have the same impact mechanism in capability, one impact force of the tool of "two impact per one revolution" becomes half as compared with one impact force of the tool of "one impact per one revolution", and an impact frequency of the tool of "two impact per one revolution" becomes twice of an impact frequency of the tool of "one impact per one revolution". That is, in the tool of "two impact per one revolution", an impact failure may occur because the impact frequency becomes high in a high load operation and responsibility of a hydraulic pressure generation mechanism worsens, etc. Here, the impact frequency means a frequency in impulse by oil compression of the hydraulic pressure generator.

SUMMARY OF THE INVENTION

One or more embodiments of the invention provide an electric power tool for suppressing continuation of an impact failure in a type in which a hydraulic pressure generator makes one revolution to produce a plurality of impacts, and a motor control method of the electric power tool.

In accordance with one or more embodiments of the invention, an electric power tool is provided with: a motor; a hydraulic pressure generator driven by the motor and configured to generate a plurality of impacts in one revolution thereof; an impact angle detector configured to detect an impact angle in one impact of the hydraulic pressure generator; an electric current detector configured to detect an electric current applied to the motor; a determination unit configured to determine an impact failure based on the impact angle and the electric current detected by the impact angle detector and the electric current detector; and a rotation controller configured to decrease a rotation speed of the motor when the determination unit determines the impact failure.

Moreover, in accordance with one or more embodiments of the invention, in an electric power tool in which a hydraulic pressure generator driven by a motor generates a plurality of impacts in one revolution thereof, the motor is controlled by: detecting an impact angle in one impact of the hydraulic pressure generator; detecting an electric current applied to the motor; determining an impact failure based on the detected impact angle and the detected electric current; and decreasing a rotation speed of the motor when the impact failure is determined.

In the above electric power tool and its motor control method, an impact failure is determined based on the impact angle in one impact of the hydraulic pressure generator and the applied electric current proportional to the torque of the motor and the rotation speed of the motor is decreased when an impact failure is detected, so that a continuation of impact failure is suppressed. That is, according to the power electric tool and its motor control method of the embodiments of the invention, the impact failure is prevented as described above and thus an operation efficiency becomes good and a smooth fastening operation can be performed and the usability of the power electric tool becomes good.

Other aspects and advantages of the invention will be apparent from the following description, the drawings and the claims.

DETAILED DESCRIPTION OF THE EXEMPLARY EMBODIMENTS

First Embodiment

Figure 1:
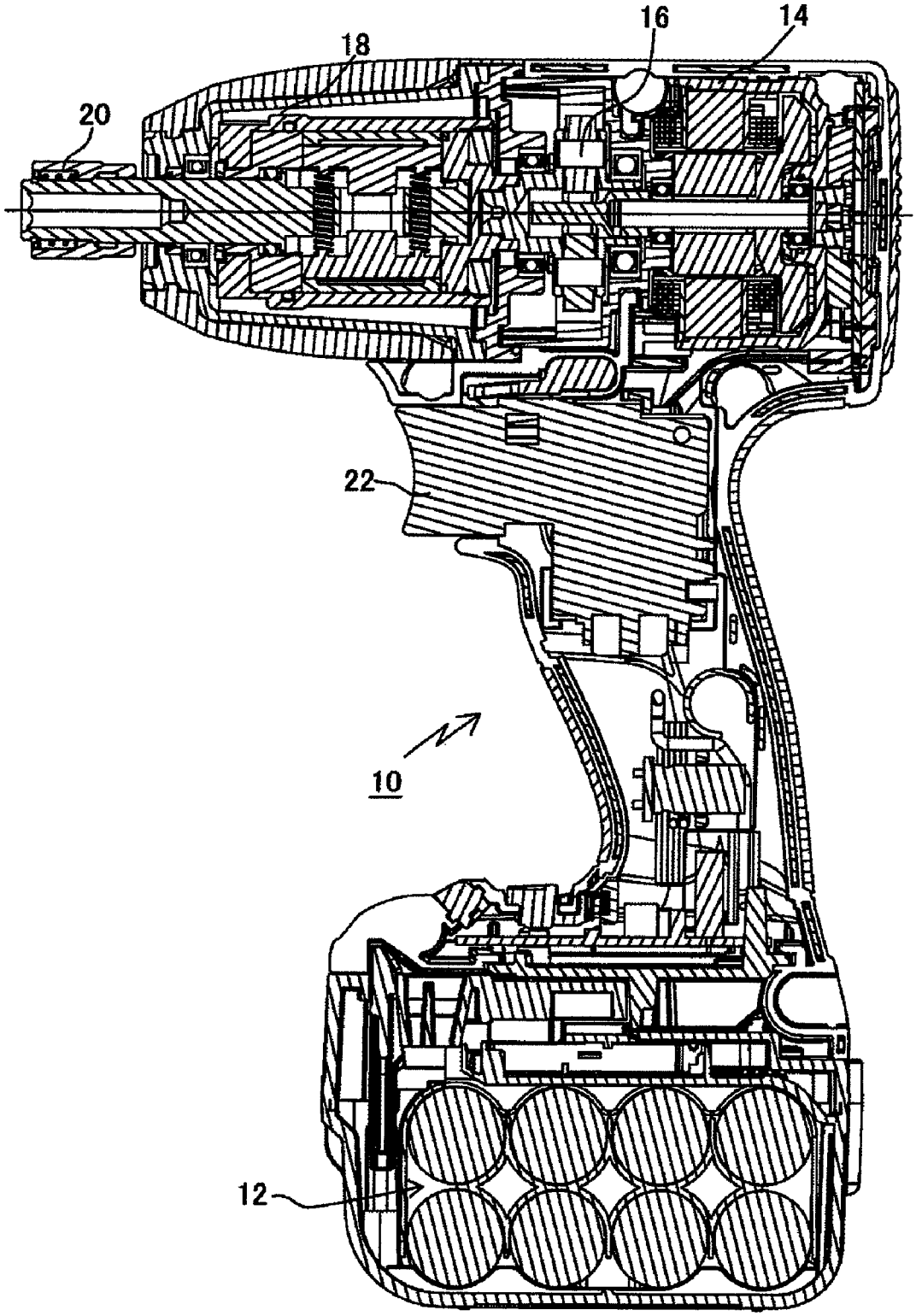
FIG. 1 is a sectional view of an electric power tool (oil pulse driver) of a first embodiment according to the invention.

An electric power tool and its motor control method of a first embodiment of the invention is described based on an example of an oil pulse driver of multiple impacts per revolution (in the example, two impacts per revolution) shown in FIG. 1.

(Schematic Configuration of Oil Pulse Driver)

As shown in FIG. 1, an oil pulse driver 10 includes a battery 12 as a power supply, a brushless DC motor (which will be hereinafter also simply called motor) as a drive means, a speed reducer 16 for slowing down a rotation of the motor 14, a hydraulic pressure pulse generation mechanism 18 for receiving output of the speed reducer 16 and generating a hydraulic pressure pulse, a main shaft 20 to which a rotation impact force by the hydraulic pressure pulse generation mechanism 18 is transmitted, and a trigger lever 22. A driver bit (not shown) is attached to the main shaft 20. The battery 12 is placed detachably.

(Configuration Concerning Hydraulic Pressure Pulse Generation Mechanism)

Figure 2:
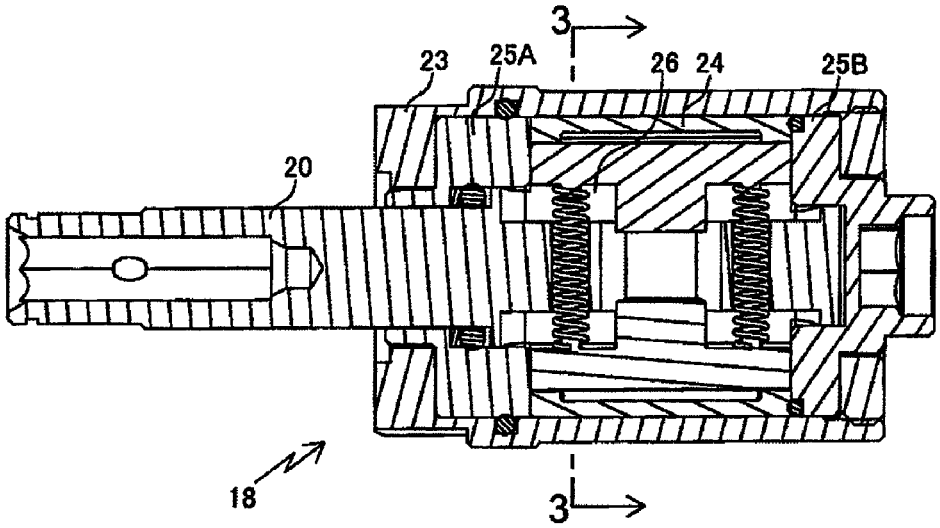
FIG. 2 is a sectional view of a hydraulic pressure pulse generator shown in FIG. 1.

The configuration concerning the hydraulic pressure pulse generation mechanism will be discussed based on FIGS. 2 and 3. As shown in FIG. 2, the hydraulic pressure pulse generation mechanism 18 is provided with a hydraulic pressure generator 24 in a hydraulic pressure generator case 23 and the main shaft 20 is inserted into the hydraulic pressure generator 24 and the hydraulic pressure generator 24 can rotate relative to the main shaft 20. At both ends of the hydraulic pressure generator 24, hydraulic pressure generator plates 25A and 25B are placed so as to seal oil in a state in which oil is filled to generate a torque in the hydraulic pressure generator 24. The hydraulic pressure generator case 23 and the hydraulic pressure generator 24 are jointed and rotate in one piece by rotation of the motor 14.

Figure 3:
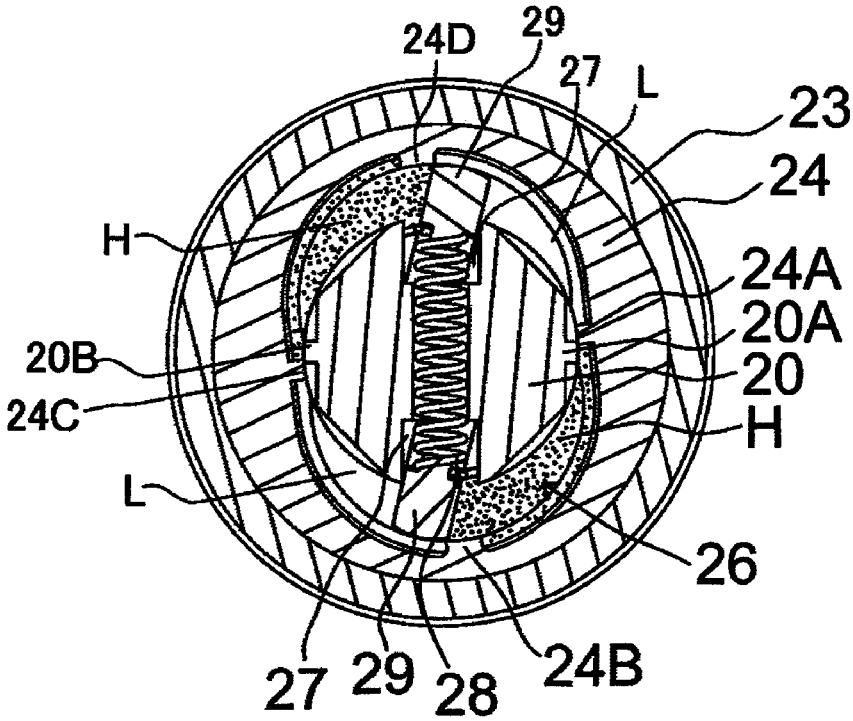
FIG. 3 is a sectional view taken on line 3-3 in FIG. 2.
Figure 4:
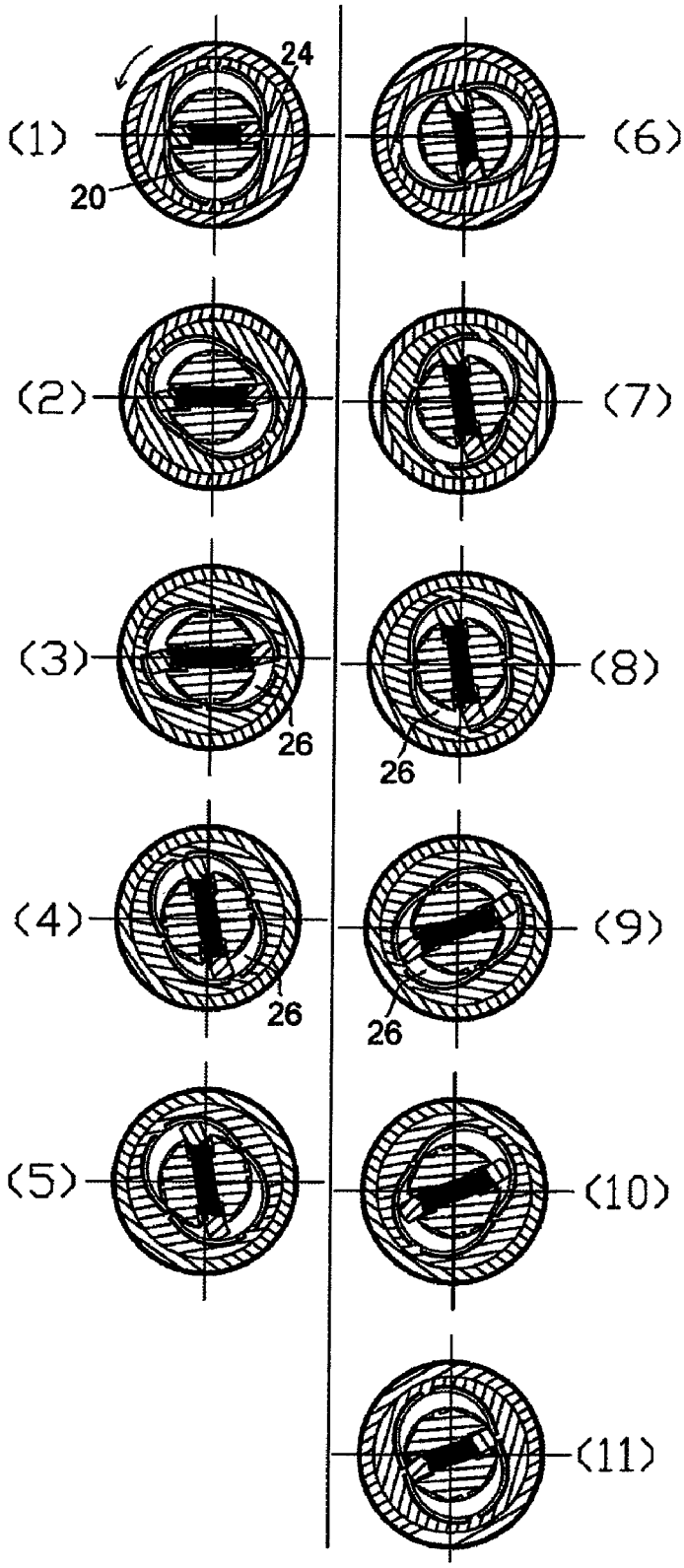
FIG. 4 is a drawing to show motions in one revolution in the hydraulic pressure pulse generator in FIG. 3.

As shown in FIG. 3, a hydraulic pressure generator chamber 26 elliptical in cross section is formed in the hydraulic pressure generator 24. A pair of blades 29 placed through a spring 28 is inserted into a pair of opposed grooves 27 of the main shaft 20 in the hydraulic pressure generator 24. The blade 29 moves while abutting the inner face of the hydraulic pressure generator chamber 26 by the urging force of the spring 28. In the main shaft 20, a pair of seal parts 20A and 20B is projected between the paired blades 29. On the inner peripheral surface of the hydraulic pressure generator 24, four seal parts 24A, 24B, 24C, and 24D are projected at both ends of a short shaft elliptical in cross section and at both ends of a long shaft. As shown in FIG. 4, when the hydraulic pressure generator 24 makes one revolution relative to the main shaft 20, the hydraulic pressure generator chamber 26 are twice sealed and partitioned in two high pressure chambers H and two low pressure chambers L (see FIG. 3).

(1) to (5) of FIG. 4 show conditions in which the relative angle between the hydraulic pressure generator 24 and the main shaft 20 is from 0 degrees to 180 degrees, and (6) to (11) of FIG. 4 show conditions in which the relative angle between the hydraulic pressure generator 24 and the main shaft 20 is from 180 degrees to 380 degrees. In (3) and (4) of FIG. 4, the first impact is performed on the main shaft by an impulse pulse, and in (8) and (9) of FIG. 4, the second impact is performed. That is, while the hydraulic pressure generator 24 makes one revolution relative to the main shaft 20, two impacts (two impacts per revolution) are performed. The hydraulic pressure pulse generation mechanism of the embodiment is similar to a conventional known mechanism and therefore will not be discussed in more detail.

(Configuration Concerning Control System of Oil Pulse Driver)

Figure 5:
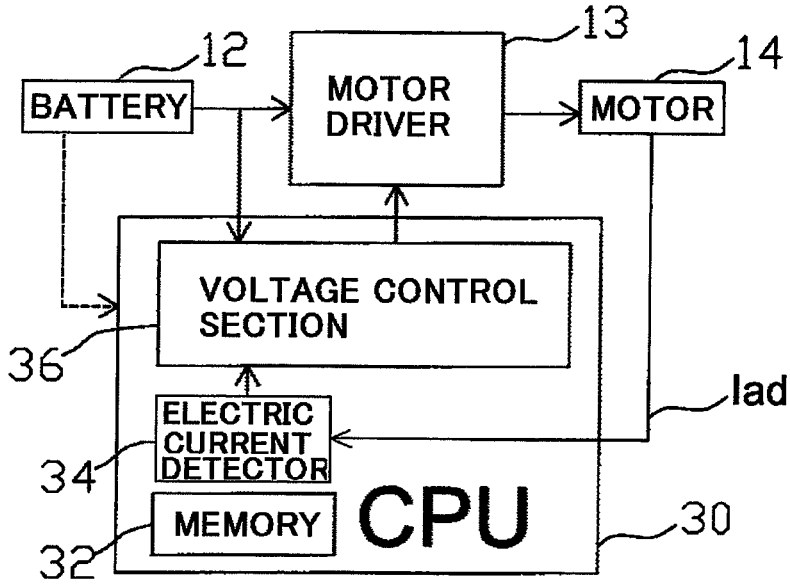
FIG. 5 is a block diagram of the electric power tool shown in FIG. 1.

The oil pulse driver includes a battery 12, a motor driver 13, a motor 14, and a CPU 30, as shown in FIG. 5. The CPU 30 of a determination unit and a rotation controller includes non-volatile memory 32, an electric current detection section 34, and a voltage control section 36, and controls the whole operation of the oil pulse driver 10. The memory of record means has a storage area for storing programs for controlling various types of processing and a record area for reading and writing various pieces of data and computation data, etc., is recorded in the record area. The CPU 30 is connected to the battery 12 and a voltage is applied to the CPU.

As shown in FIG. 2, an electric current is input to the electric current detection section 34 from the rotating motor 14 and a voltage of the battery 12 is input to the voltage control section 36 of voltage detection means. The voltage control section 36 outputs a predetermined drive voltage of the motor 14 to the motor driver 13 based on the electric current input to the electric current detection section 34 (namely, load torque) and the voltage input to the voltage control section 36.

The reason why the motor 14 is a brushless motor is as follows: The brushless motor has small moment of inertia of a rotor as compared with a brush motor and thus if the hydraulic pressure pulse generation mechanism is applied to the type of two impacts per revolution, a change in the rotation speed of the motor is also small. That is, in the brushless motor, a change in the rotation speed caused by load variation is large output, but if the hydraulic pressure pulse generation mechanism is of the type of two impacts per revolution, load variation is small and thus a change in the rotation speed caused by load variation is also small.

(Operation of Embodiment)

Figure 6:
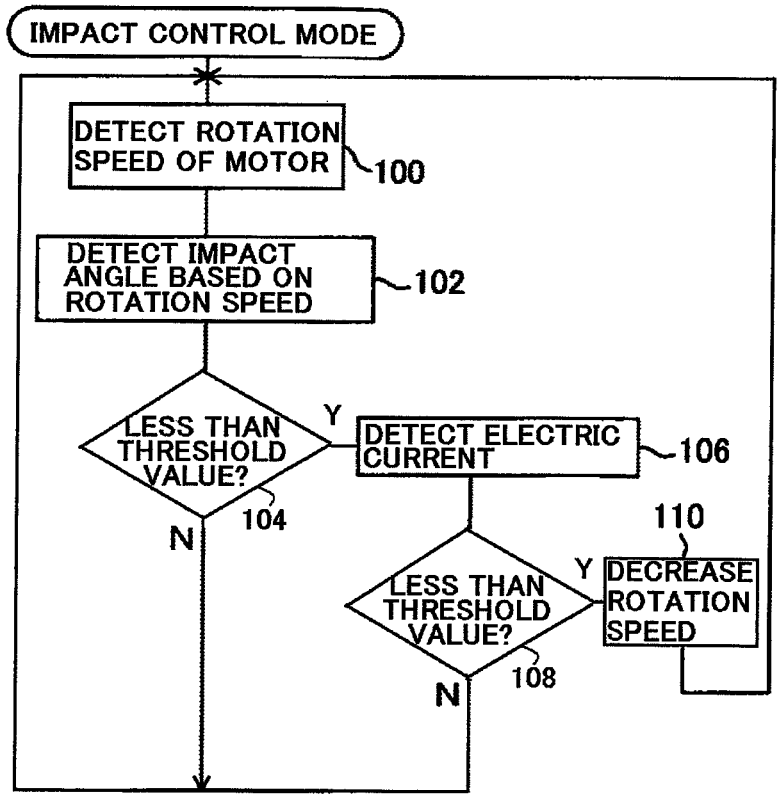
FIG. 6 is a flowchart concerning an impact control mode of the electric power tool shown in FIG. 1.

Processing concerning an impact control mode will be discussed based on a flowchart shown in FIG. 6. When the trigger lever 22 is pulled and a switch (not shown) is turned on, the CPU 30 loads a program, whereby processing in the oil pulse driver 10 is executed. The executed processing routine is represented by the flowchart of FIG. 6 and the programs are previously stored in the program area of the memory 32 (see FIG. 5). The routine is processing while the motor 14 (see FIG. 5) is rotating.

Figure 9:
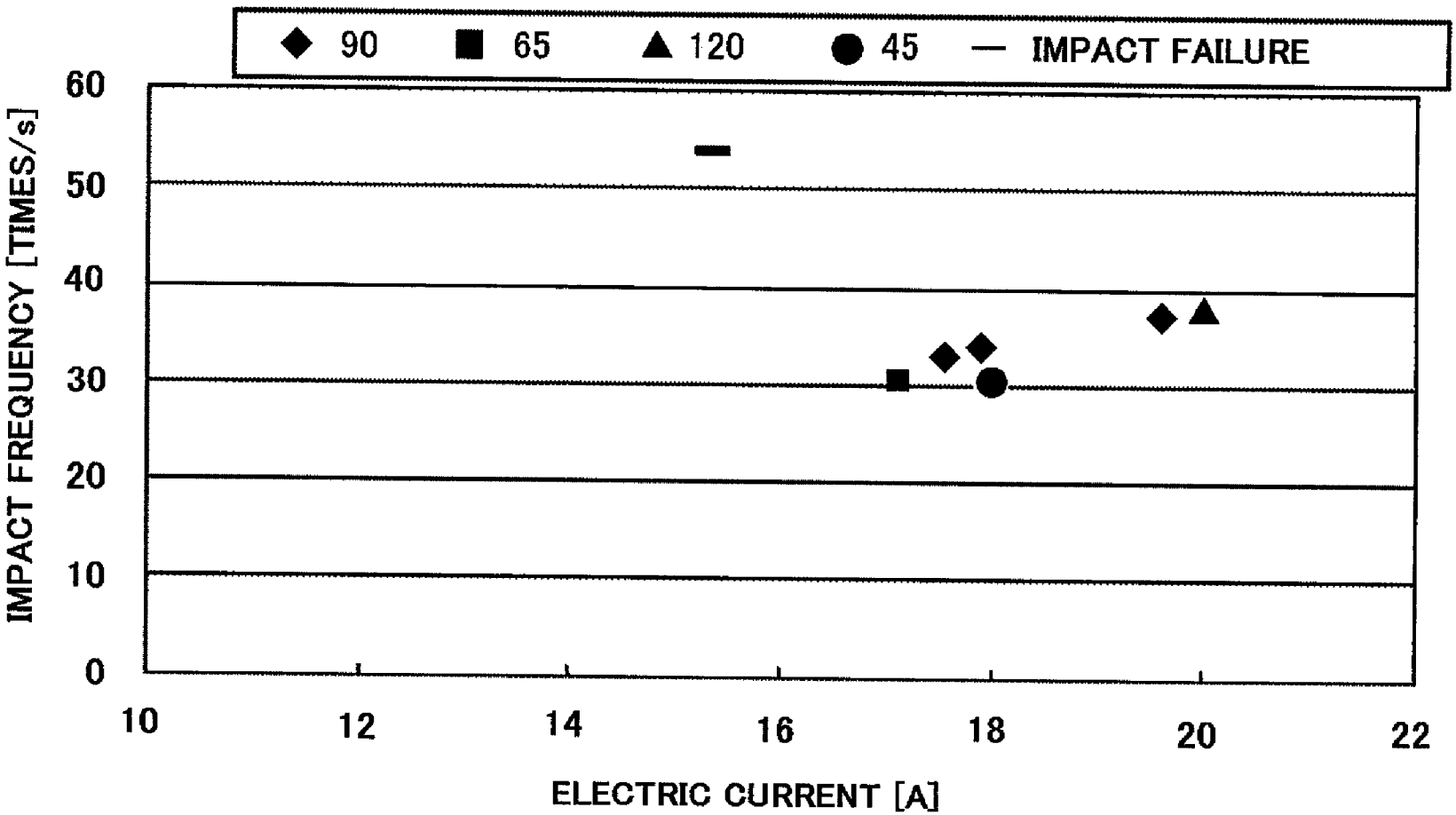
FIG. 9 is a drawing to describe the difference between normal impact and impact failure.

On the other hand, an impact failure can occur when the impact frequency is a given value or more, for example, 50 (times/s) or more. At this time, the angle advanced by one impact becomes small as compared with normal impact. That is, as shown in FIG. 9, when the angle advanced by one normal impact is small, the load on the motor is heavy and at the impact failure time, the load on the motor 14 is light although the impact angle is small.

Therefore, an impact failure occurs when the advance angle per impact (which will be hereinafter also called impact angle) is small and the consumption electric current is small (namely, the load on the motor 14 is light). In the embodiment, an impact failure is determined by the impact angle and by whether or not the consumption electric current is equal to or less than a threshold value. When an impact failure occurs, the rotation speed of the motor 14 increases and the consumption electric current also becomes small and thus the impact failure continues.

(Impact Control Mode)

Figure 7A:
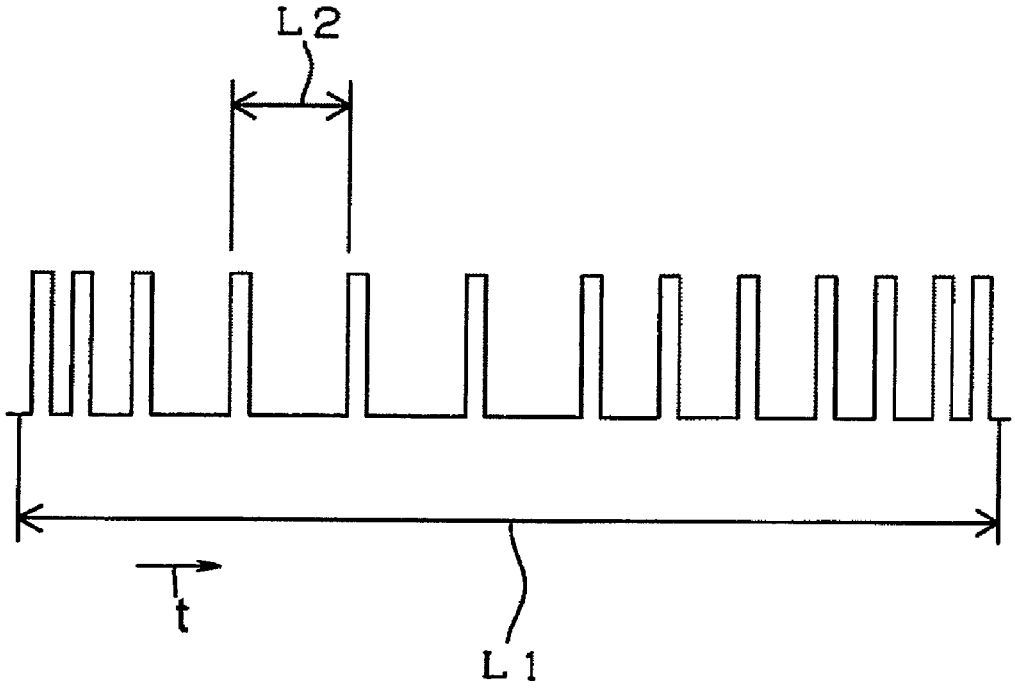
FIG. 7A is a pulse chart in one impact.
Figure 7B:
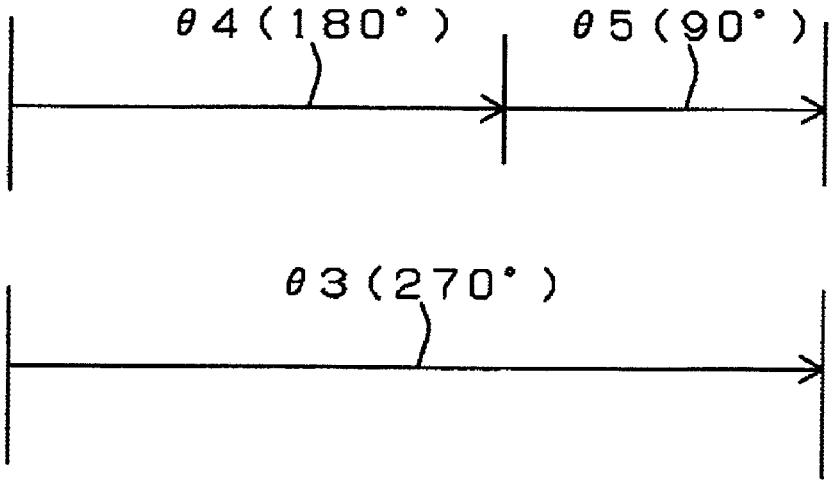
FIG. 7B is a drawing to show motor rotation angle and impact angle.
Figure 8:
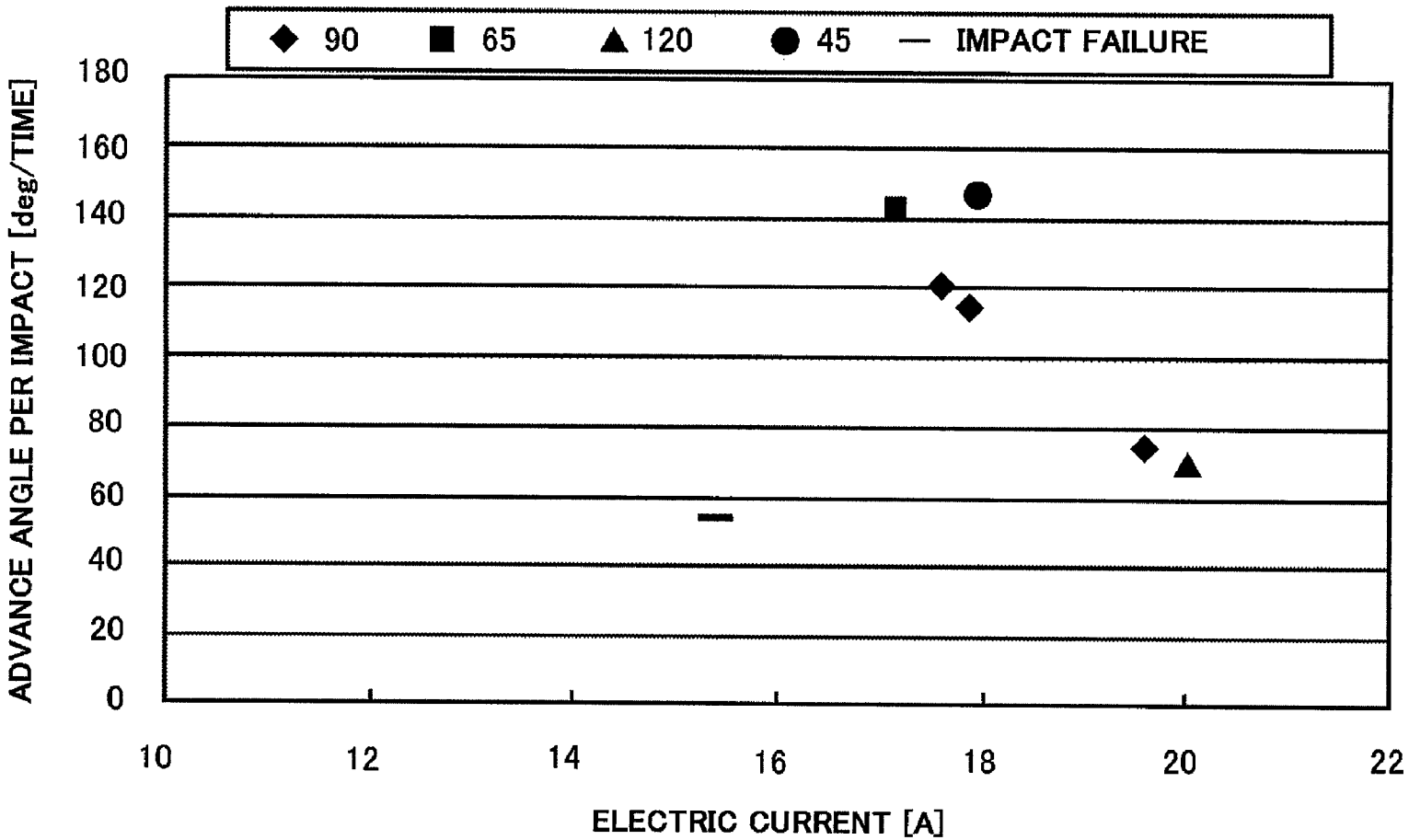
FIG. 8 is a drawing to describe the difference between normal impact and impact failure.

At step 100 shown in FIG. 6, the CPU 30 detects the rotation speed of the motor 14. The rotation speed is computed (synonymous with detected) with time t of pulse-to-pulse width L2. At step 102, the CPU 30 detects the impact angle based on the rotation speed (namely, the rotation speed) detected at step 100. The advance angle of the motor 14 (also containing the impact angle) is computed based on the number of pulses output by one impact shown in FIG. 7A and is determined. That is, as shown in FIG. 7B, the CPU 30 subtracts idle running angle θ4 of the motor 14 (this angle is constant) from advance angle θ3 of the motor 14 (this angle varies), thereby computing impact angle θ5 of screw advance (this angle varies).

At step 104, the CPU 30 determines whether or not the impact angle detected at step 102 is equal to or less than a threshold value based on the threshold value read from the memory 32, for example, 60 degrees. If the determination at step 104 is NO, namely, the impact angle is more than the threshold value, the CPU 30 determines that, for example, a screw, etc., is struck against a material of a light load, and returns to step 100. If the determination at step 104 is YES, namely, the impact angle is equal to or less than the threshold value, the CPU 30 goes to step 106 and the electric current detection section 34 of the CPU 30 detects consumption electric current Iad of the motor 14.

At step 108, whether or not the consumption electric current detected at step 106 is less than a threshold value, for example, 16A is determined. If the determination at step 108 is N, namely, the consumption electric current is equal to or more than the threshold value, the load on the motor 14 is a predetermined load or more and thus the CPU 30 determines normal impact and returns to step 100. If the determination at step 108 is Y, namely, the consumption electric current is less than the threshold value, the load on the motor 14 is less than the predetermined load and thus the CPU 30 determines an impact failure and the rotation speed of the motor 14 is decreased in the voltage control section 36.

The processing of the routine is repeated while the motor 14 rotates. The processing flow of the program described above (see FIG. 6) is an example and can be changed as required without departing from the spirit of the invention. For example, at step 102, impact frequency may be detected (also in this case, the impact angle is determined based on the impact frequency) and at step 104, whether or not the impact frequency is equal to or more than a predetermined value, for example, 50 (times/s) may be determined. If the impact frequency is equal to or more than the predetermined value, the process goes to step 106.

According to the embodiment, an impact failure is determined based on the impact angle of one impact by the hydraulic pressure generator 24 and the load electric current proportional to the load torque of the motor 14 and if an impact failure is detected, the rotation speed of the motor 14 is decreased and thus continuation of impact failure is suppressed. That is, according to the embodiment, impact failure is prevented as described above and thus operation efficiency becomes good and smooth fastening operation can be performed and the usability of the oil pulse driver 10 becomes good. According to the embodiment, two impacts per revolution is small torque multiple impacts and thus come out is prevented.

Figure 10:
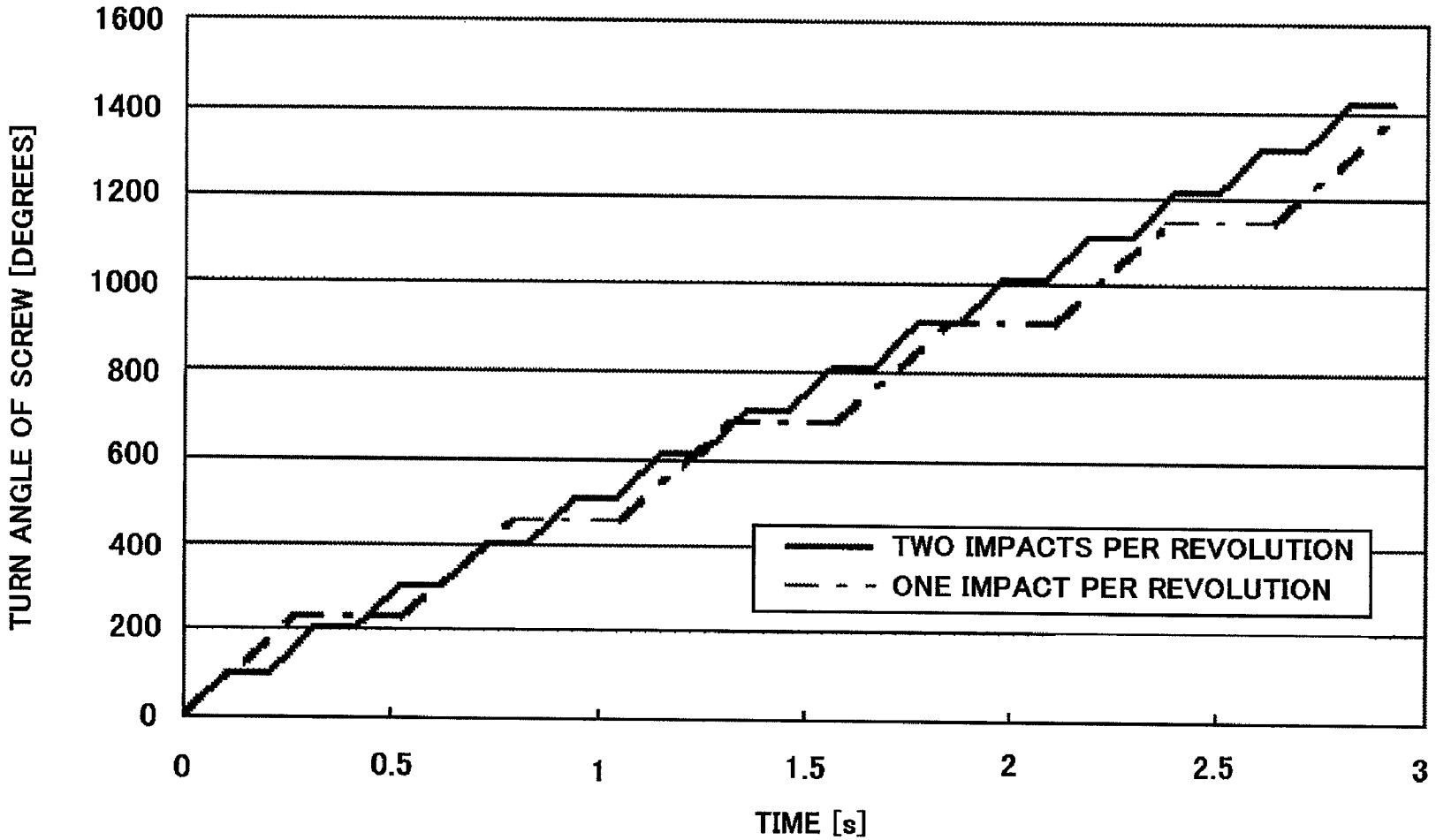
FIG. 10 is a drawing to show a state in which a 90-mm screw is driven.
Figure 11:
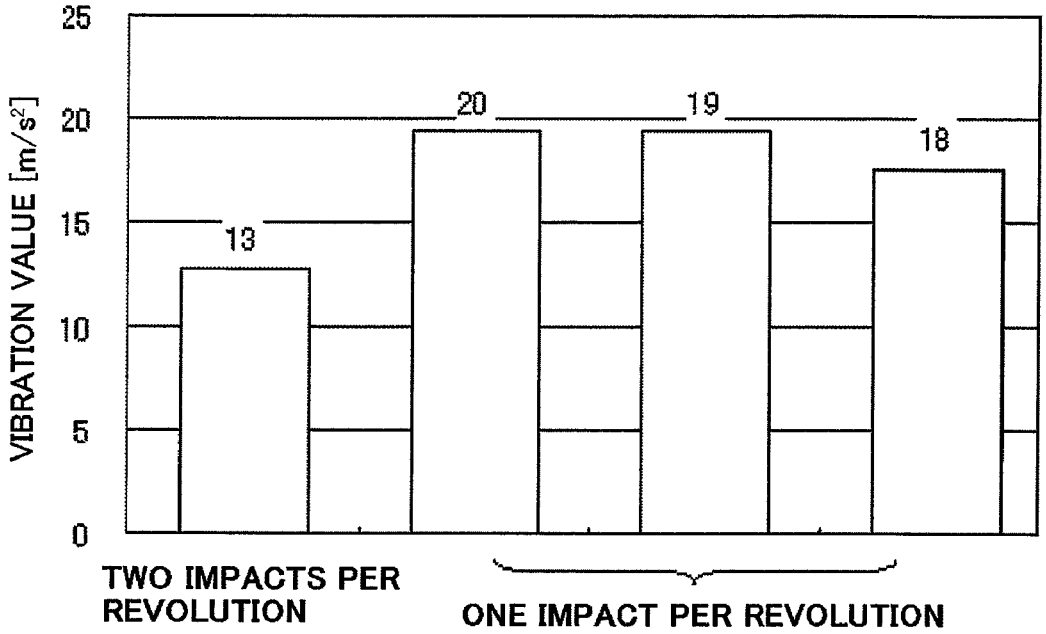
FIG. 11 is a drawing to show the vibration difference between two impacts per revolution and one impact per revolution.

For impact at the fastening time of a 90-mm screw, as shown in FIG. 10, the time per impact is short in the hydraulic pressure pulse generation mechanism of the type of two impacts per revolution as compared with the type of one impact per revolution and thus the torque force weakens and striking sense becomes good. Vibration of the oil pulse driver 10 shown in FIG. 1 is small in the hydraulic pressure pulse generation mechanism of the type of two impacts per revolution as compared with the type of one impact per revolution as shown in FIG. 11 and thus usability is good. Three kinds of types of one impact per revolution in FIG. 11 show examples of oil pulse drivers each having a different hydraulic pressure pulse generation mechanism.

Further, the voltage control section 36 may cause the motor driver 13 to output the drive electric current corresponding to the optimum rotation speed of the motor 14 based on the electric current input to the electric current detection section 34 and the voltage input to the voltage control section 36. In this case, rotation of the motor is not affected by the voltage of the battery 12 shown in FIG. 1 and thus particularly occurrence of an impact failure at the full charging time can be prevented. The optimum rotation speed is the rotation speed where an operation of impact, etc., for example, can be performed most efficiently if the load torque of the motor 14 changes.

Second Embodiment

An electric power tool and its motor control method of a second embodiment of the invention will be discussed below with a block diagram of an oil pulse driver shown in FIG. 12: Parts identical with those of the first embodiment described above are denoted by the same reference numerals and will not be discussed again or is simplified and differences will be mainly discussed.

A CPU 40 of a rotation controller includes nonvolatile memory 42, an electric current detection section 44, and a rotating speed controller 46 and controls the whole operation of the oil pulse driver 10 shown in FIG. 1. The memory 42 of record means has a storage area for storing programs for controlling various types of processing and a record area for reading and writing various pieces of data and the impact angle, the threshold value data of consumption electric current, and the like are recorded in the record area.

Figure 12:
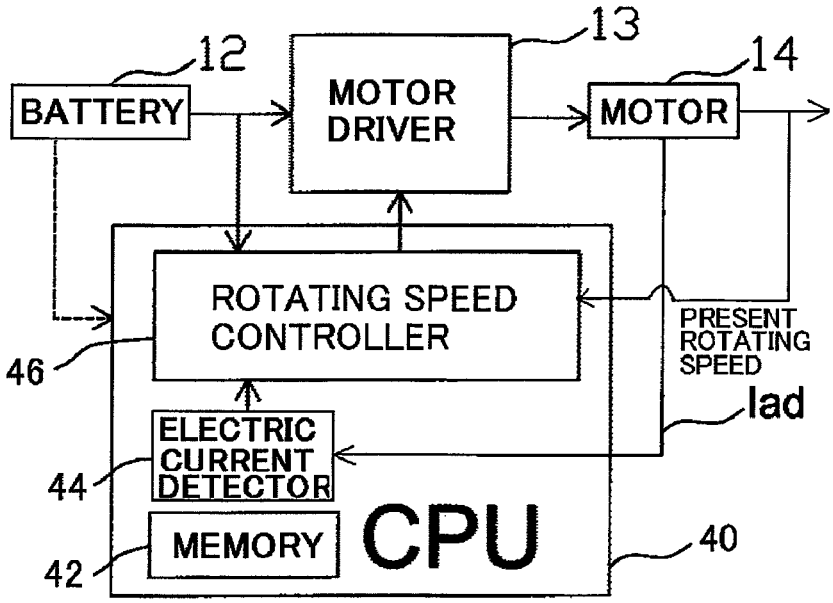
FIG. 12 is a block diagram of an electric power tool of a second embodiment according to the invention.

As shown in FIG. 12, electric current Iad is input to the electric current detection section 44 from a rotating motor 14 and the electric current rotation speed of the motor is input to the rotating speed controller 46. The rotating speed controller 46 of the CPU 40 determines whether or not an impact failure occurs based on the impact angle and the load electric current of the motor 14 input to the electric current detection section 44. If an impact failure occurs, the rotating speed controller 46 computes motor output voltage from the electric current rotation speed and outputs the motor output voltage to a motor driver 13.

The rotating speed controller 46 may compute the target rotation speed based on the load electric current of the motor 14 input to the electric current detection section 44 and the voltage of a battery 12 and may compute motor output voltage according to the difference between the computed target rotation speed and the electric current rotation speed and may output the motor output voltage to the motor driver 13. In this case, the rotating speed controller 46 controls so that the rotation speed of the motor 14 becomes the target rotation speed by PI control (proportional-plus-integral control), for example. That is, the motor drive voltage is not directly computed based on load electric current and the target rotation speed may be once computed based on the load electric current of the motor 14 and the voltage of the battery and finally the motor output voltage may be computed based on the difference between the numbers of revolutions described above.

The rotation speed of the motor 14 is detected based on inverse striking voltage of the rotating motor 14 and rotation sensor (hall sensor, encoder), for example. Other components and functions and effects are the same as those of the first embodiment.

In each embodiment described above, the electric power tool is the oil pulse driver of two impacts per revolution by way of example, but the invention can also be applied to thread fastening power electric tools of an oil pulse driver of three or more impacts per revolution, other impact drivers, etc., for example. The invention can also be applied to a power electric tool using a commercial power supply as a power supply.

DESCRIPTION OF REFERENCE NUMERALS AND SIGNS

10 Oil pulse driver (electric power tool)
12 Battery
14 Brushless DC motor (drive means)
18 Hydraulic pressure pulse generation mechanism
20 Main shaft
24 Hydraulic pressure generator
28 Spring
29 Blade
30, 40 CPU (a determination unit and a rotation controller)
32, 42 Memory (record means)
34, 44 Electric current detection section (an electric current detector)
36 Voltage control section (voltage detection means and voltage control means)
46 Rotating speed controller (voltage detection means and rotation speed control means)

What is claimed is:

1. An electric power tool comprising:

a motor;

a hydraulic pressure generator driven by the motor and configured to generate a plurality of impacts in one revolution thereof;

an impact angle detector configured to detect an impact angle in one impact of the hydraulic pressure generator;

an electric current detector configured to detect an electric current applied to the motor;

a determination unit configured to determine an impact failure based on the impact angle and the electric current detected by the impact angle detector and the electric current detector; and a rotation controller configured to decrease a rotation speed of the motor when the determination unit determines the impact failure.

2. A motor control method of an electric power tool in which a hydraulic pressure generator driven by a motor generates a plurality of impacts in one revolution thereof, the method comprising:

detecting an impact angle in one impact of the hydraulic pressure generator with an impact angle detector;

detecting an electric current applied to the motor with an electric current detector;

determining an impact failure based on the detected impact angle and the detected electric current with a determination unit; and decreasing a rotation speed of the motor when the impact failure is determined with a rotation controller.

* * * * *